US005399136A

United States Patent [19]

Bart

[11] Patent Number: 5,399,136

[45] Date of Patent: Mar. 21, 1995

[54] STRING ACTUATED ROTATABLE BALL

[75] Inventor: Philip D. Bart, Ft. Lauderdale, Fla.

[73] Assignee: Owl Toy & Novelty Corporation, Ft. Lauderdale, Fla.

[21] Appl. No.: 74,204

[22] Filed: Jun. 9, 1993

[51] Int. Cl.[6] ..... A63B 21/22

[52] U.S. Cl. ..... 482/110; 446/242; 446/247; 446/254; 446/265

[58] Field of Search ..... 482/110, 126, 127; 446/175, 236, 242, 243, 247, 253, 254, 265, 248, 249

[56] References Cited

U.S. PATENT DOCUMENTS

| | | | |
|---|---|---|---|
| 787,404 | 4/1905 | Schaller | 446/256 |
| 1,258,464 | 3/1918 | Riley | 446/254 |
| 1,431,604 | 10/1922 | Stenons | 446/236 |
| 2,739,419 | 3/1956 | Cleveland | 446/253 |
| 2,957,271 | 10/1960 | Heywood, Jr. | 446/249 |
| 3,269,727 | 8/1966 | Samuel | 432/110 |
| 3,737,162 | 6/1973 | Wood | 482/110 |

*Primary Examiner*—Richard J. Apley
*Assistant Examiner*—Lynne A. Reichard
*Attorney, Agent, or Firm*—Malin, Haley, DiMaggio & Crosby

[57] ABSTRACT

A toy and exercising device that utilizes a rounded body, such as a sphere, a pair of cord segments through said sphere on each side, and a pair of handles attached to the ends of the cord segments. The cord segments are spaced to allow twisting of the cord upon itself on each side of the device to cause the sphere to be rotated in a forward and reverse direction by pulling against the twisted cord with the handles. The exercising device can be adjusted to require variable force to successfully rotate the sphere in both directions by providing for variable spacing of the apertures that receive the cord on each side of the sphere. The device may also include a variable illuminating device inside the sphere that will illuminate above a certain predetermined rotational velocity. The device can also include variable audible sounds generated by surface elements disposed in or on the surface of the sphere. Alternatively, a whistle-like sound can be generated by a sound box and slot mounted at one end of the rotatable shaft. A rotatable shaft in the sphere allows the cord to be rolled up and stored inside the sphere when the device is not in use.

10 Claims, 6 Drawing Sheets

STRING ACTUATED ROTATABLE BALL

BACKGROUND OF THE INVENTION

1. Field of the Invention

This invention relates generally to an apparatus for play and exercise that utilizes a ball for manual rotation through the manipulation of a string or cord passing through the ball, and specifically, to a hand-actuated, rotatable ball attached to a twistable cord, that is grasped between the hands of the user and that can be reversibly rotated by moving the hands away from and toward each other, causing a series of reversible rotations for either amusement as a toy or physical conditioning as an upper torso exercising device.

2. Description of the Prior Art

Manually actuated and string manipulated toys are known to exist in the prior art. For instance, the toy known as a "yo-yo" has been used for many years. The "yo-yo" is a rotatable device suspended from or tethered to a string at one end and rotated through single hand actuation at an opposite end. Similarly, paddle balls found in the prior art provide a ball tethered at one end of an elastic member with the other end connected to a paddle. The paddle is manipulated back and forth so that the ball bounces off the paddle in a continuous reciprocal action.

Additionally, manually actuated exercising devices are in existence today for physical conditioning. These devices normally comprise hand-maneuvered, stretchable or elastic material, incorporating a handle on each end of the material for stretching in front of the user. The handles are grasped with the hands and pulled apart against the stretch tension to build upper torso and arm strength. Such exercise is considered boring and repetitious because of the static nature inherent in the exercising device.

The present invention provides a dynamic toy and exercising device that utilizes the momentum of a sphere or ball that can be manipulated with two hands disposed out in front of the operator through the action of a twisted cord. When twisted, the cord stores potential energy that is subsequently converted into kinetic energy of rotation as the user pulls and releases the cords, causing the ball to rotate. When the tension in the cords is released, the sphere changes direction and the cord, through the kinetic energy and momentum of the ball, winds itself up again. Handles are disposed at each end of the cord for grasping by the user so that the device may be stretched and released in a repetitious fashion.

The present invention also provides for self-contained storage of the cord when the device is not in use.

The present invention can also be constructed to dynamically generate sounds based on the rotational velocity of the ball and can utilize interior visual indicia for observation through apertures in the sphere based on rpm or rotational speeds of the ball. A centrifugal force gauge can be provided on the sphere to measure objectively the maximum velocity or force achieved with the device.

Thus, the present invention provides both an amusement toy and an exercising device for the upper torso that is dynamic in nature and requires manipulative exercise and skill to sustain the rotation of the device in a dynamic state.

SUMMARY OF THE INVENTION

The present invention provides an apparatus for amusement and exercise comprising a sphere having a rigid spherical body and a hollow interior portion, a string or cord that is connected through the center of the sphere, exiting at diametrical apertures, said cord being sized in length to extend substantially between the outstretched arms of the user and a pair of grasping handles, each mounted at the end of the cord on each side. The cord has two separate segments attached to each handle, with a central portion passing through the apertures in the sphere and extending from side-to-side as a continuous cord. The use of the double cord segments permits the cord, with the ball attached through the pairs of apertures, to be twisted through rotational movement for accelerating manual rotation of the sphere.

The spherical body which may be of plastic or other similar rigid but lightweight material, also includes an internal rotatable shaft that is diametrically disposed within the sphere. The internal shaft has two apertures that receive the two cord segments. The cord can be wound around the shaft, retracting the cord segments into the sphere body when the device is not in use. Attached to one end of the shaft is a small, manually-actuated flange that allows for manual rotation of the shaft while disposed in the spherical housing, so that the cord may be wrapped around the shaft for storage purposes. This also causes each handle mounted at each end of the cord to be pulled against the exterior spherical body in the stored position. In the handle stored position, the device can be utilized as a ball for play.

In an alternate embodiment, the spherical body includes strategically sized and placed apertures or projecting scoops which interact with the air flow over the exterior surface of the sphere as the sphere is rotated, causing the device to emit sounds as it is dynamically activated. Thus, as the sphere body is rotated reciprocally, causing changes in rotation, the sounds vary, depending on the particular rotational direction of the sphere relative to the surrounding air. Moreover, the intensity of rotation will alter the pitch of the sound. The sound may also be generated by centrifugally actuated, radially projectable, sound generating members that moved radially outwardly from the surface of the sphere as the rotational velocity of the sphere increases.

In another embodiment, apertures may be placed strategically in the sphere body to allow the emission of light from lighted elements mounted inside the sphere. Accordingly, the lighted elements are energized by a centrifugal switch, which is activated by the centrifugal force of the sphere at a predetermined rpm rate. A variable light output could be created by rotational velocity. Hence, in addition to creating dynamically actuated sounds, the device could further provide certain types of visual indicia at variable or particular rotational rates.

Moreover, when utilized as a toy or amusement device, the exterior portion of the sphere may be uniquely decorated. For instance, a design may be provided to give the appearance of a face with the handles that are attached to the cords representing ears when the device is stored.

In one embodiment, the ball may be made of a hard, neoprene rubber or a hard or soft plastic material and sized approximately two to ten inches in diameter. An example may be of a durometer hardness of 70. Such a size facilitates suitable hand manipulation by various users. The weight of the ball may be as light as a few ounces or heavier, but sufficiently rigid to withstand dynamic rotation and changes of rotational direction by the operator. The cord may be defined as $\frac{1}{8}$ inch wrapped cotton, but is not limited thereto.

To actuate the device as a toy, or for use in exercising, the user would first grab each handle and hold the device in front of the upper torso with the arms extended outwardly. In this first position, the ball is suspended between the handles by the cord. The user would then rotate the ball in a particular direction through slackening the cord and moving the hands to impart rotational motion to the sphere body. Because it is a double cord, the cord wraps and twists itself in a singular direction as a result of the rotation. When the handles are pulled apart, the twisted cord unwinds, accelerating the sphere.

As an alternative embodiment to the previously described sound-generating devices, the rotatable shaft disposed within the spherical body of the ball may include at one end a sound box that is a small chamber having a slotted exterior surface, all of which is formed as part of one end of the shaft. The exterior surface at the shaft end has an elongated, substantially rectangular slot of a predetermined size. The surface slot is the opening to the sound box. The longer surface slot edges are parallel and spaced about 0.25 inch apart and are tapered (from the exterior towards the interior) surface, somewhat like a knife edge. The elongated surface slot (each longer slot edge) is perpendicular to the direction of rotation of the ball. A whistle-like sound is generated through the rotation of the ball from the slot and sound box. The sound changes in pitch as the rotational velocity of the ball changes. Thus, the sound-making device can be formed as part of the shaft that receives the cord. The sound generation surface and slot can protrude slightly at the shaft end. No other openings or indentations need to be made on the exterior surface of the ball to generate sound.

With respect to the exercising use of the device, the pairs of apertures diametrically opposed can be spaced apart a variable distance to increase or decrease the amount of strength or force required for inducing rotation of the ball. Thus, if more exercise force and user strength is desired, the cord hole distance on each side would be spaced apart a greater distance, therefore requiring more twisting distance and pull force. The device could be used arm-to-arm, arm-to-leg, or between two people for exercise purposes.

It is an object of this invention to provide an apparatus that is useful as both a toy and an exercising device that utilizes the rotational motion of a sphere in conjunction with a twisted cord for manual manipulation.

It is another objection of this invention to provide a dynamic toy that can also be used as an exercising device, providing for audible sounds and illuminated indicia inside a rotatable sphere, each of which is a function of the rotation velocity of the sphere.

And yet another object of this invention is to provide a toy and exercising device that utilizes a sphere and a cord that can be stored within the sphere housing when the device is not in use.

In accordance with these and other objects which will be apparent hereinafter, the instant invention will now become described with particular reference to the accompanying drawings.

BRIEF DESCRIPTION OF THE DRAWINGS

FIG. 9A shows a side elevational view in cross section of the invention, including a sound or whistle-generating box attached to a portion of the shaft used with the present invention without the cord.

DESCRIPTION OF THE PREFERRED EMBODIMENT

Figure 1:
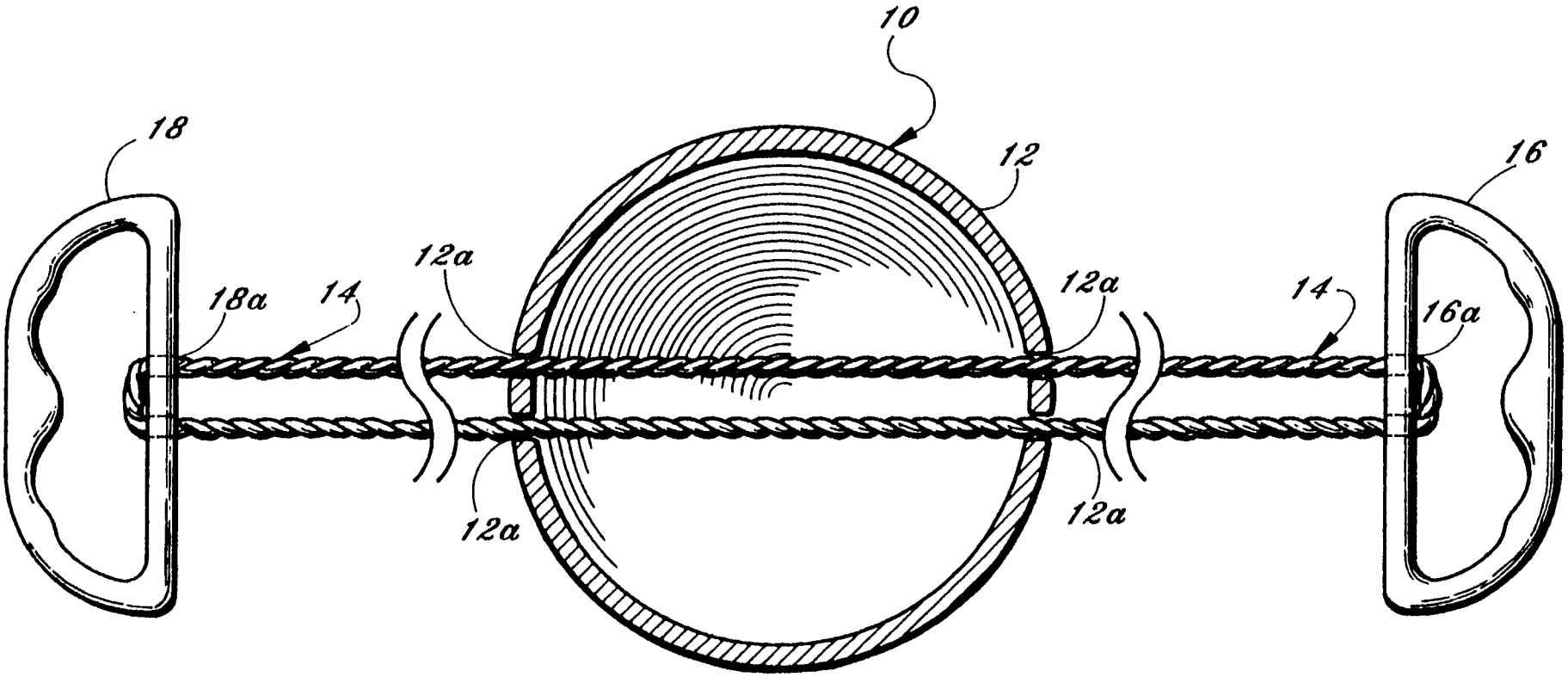
FIG. 1 shows a front elevational view of the invention partially in cross section.

Referring now to the drawings and in particular, to FIG. 1, the present invention is shown generally at 10, comprised of a rigid sphere 12 that is hollow, a cord 14 disposed through two pair of apertures 12*a*, diametrically opposed across the sphere 12, and essentially rigid, plastic handles 16 and 18 connected to cord 14. The cord 14 may be one continuous elongated cord that is braided together after passing through apertures 12*a* of sphere 12 and apertures 16*a* and 18*a* disposed in handles 16 and 18, respectively, so that the handles 16 and 18 are firmly attached to the cord. The cord 14 further comprises two segments, allowing it to be twisted. Thus, each side of the sphere provides two apertures 12*a*, said apertures containing the cord which passes back and forth through the sphere twice, said cord having two segments stretching from the sphere 12 to each handle 16 and 18.

To use the embodiment shown in FIG. 1, the user would grasp handles 16 and 18, one in each hand, and initially cause the sphere 12 to rotate in either direction around its axis and around cord 14 so that the cord becomes twisted toward each handle 16 and 18 on both sides of the sphere. Once the cord 14 has become sufficiently twisted upon itself, the user may then pull very hard on each handle 16 and 18 in a direction to separate the handles, creating tension on the string 14, such that it will untwist or unravel to cause sphere 12 to rotate rapidly. The sphere will continue rotating while the cord completely untwists and will go beyond that point due to its momentum, causing the cord to tightly twist again upon itself. The handles may then be pulled another time, causing the sphere to rotate in the opposite direction as induced by the pulling force of the twisted cord. This reciprocal rotational motion may be repeated for as long as desired, or until the user gets tired, wherein the ball is caused to change rotational directions each time the cord is twisted and untwisted. Rapid spherical velocities can be achieved repeatedly.

Figure 2:
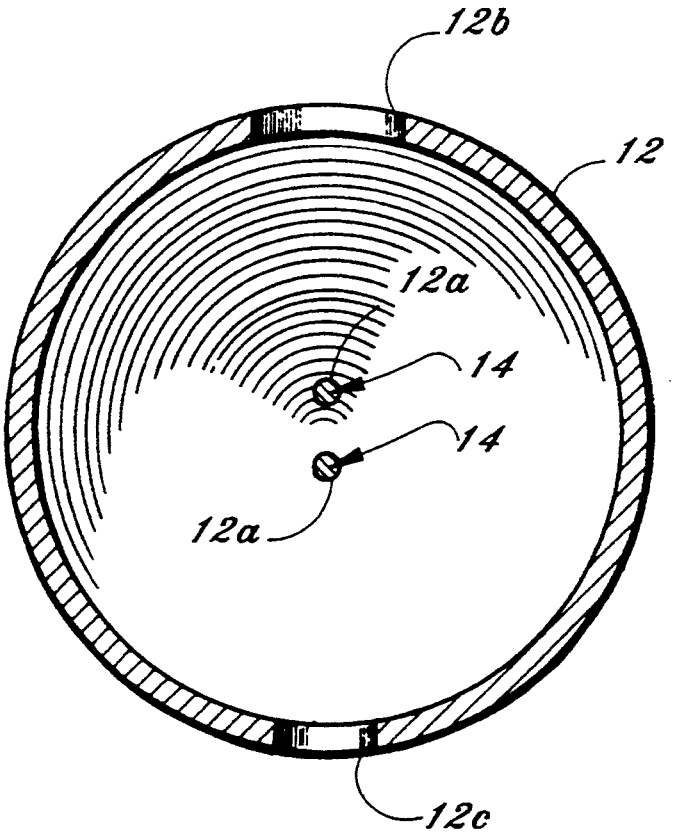
FIG. 2 shows a side elevational view in cross section of the present invention of the embodiment of FIG. 1 without the cord.
Figure 3:
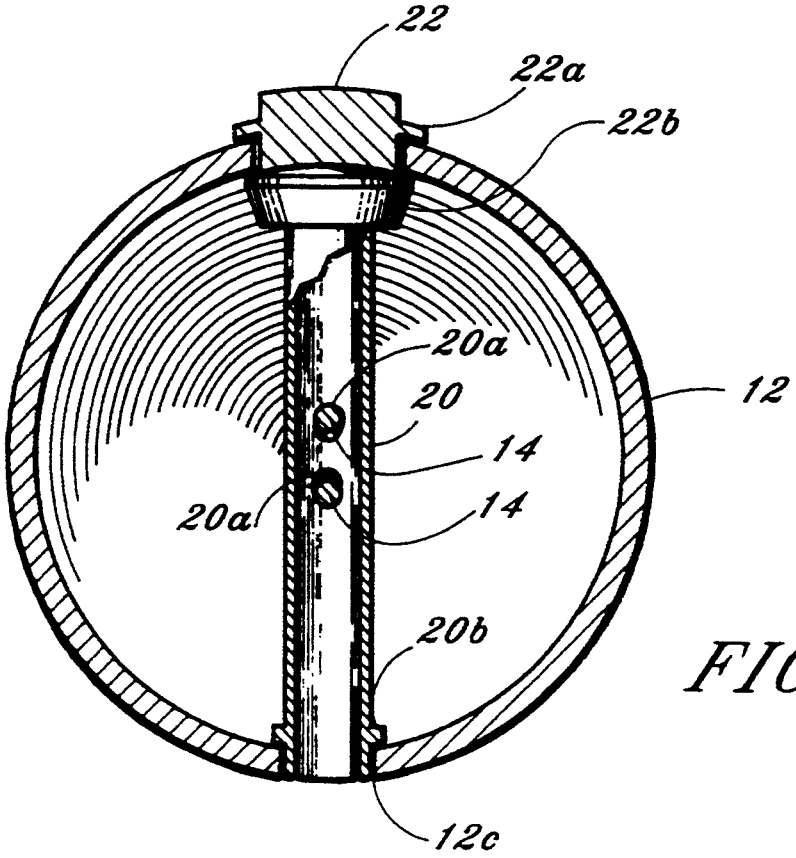
FIG. 3 shows a side elevational view in cross section of an alternative embodiment of the present invention with an internal rotatable shaft without the cord.

FIGS. 2 and 3 show an alternate preferred embodiment of the invention, wherein the sphere 12 includes a pair of larger diametrically opposed apertures 12*b* and 12*c*, which, as shown in FIG. 3, receive a rigid tubular shaft 20 that is affixed internal thereto diametrically across sphere 12. The shaft 20 has a circular flange 20*b* at one end and a protruding portion that can fit in aperture 12*c*. A manually actuated knob 22 is disposed within aperture 12*b* and connected to shaft 20. Shaft 20 also has a pair of apertures 20*a*, and a separate flange 22*b* surrounding and proximal the manual actuating handle 22 with its outer flange 22*a* surrounding handle 20. The purpose of rigid shaft 20 is to receive the cord 14 as it passes through the shaft in both directions. The shaft 20 can rotate by the actuation and movement of handle 22, which rotates the shaft 20 in either direction. With cord 14 passing through the pair of apertures 20*a* in shaft 20, the cord 14 can be wrapped around shaft 20 to allow for storage of the cord inside the sphere when the device is not in use. The rotation is accomplished by manually rotating handle 22, which may be likened to a knob, in either direction, causing shaft 20 to rotate.

Figure 4:
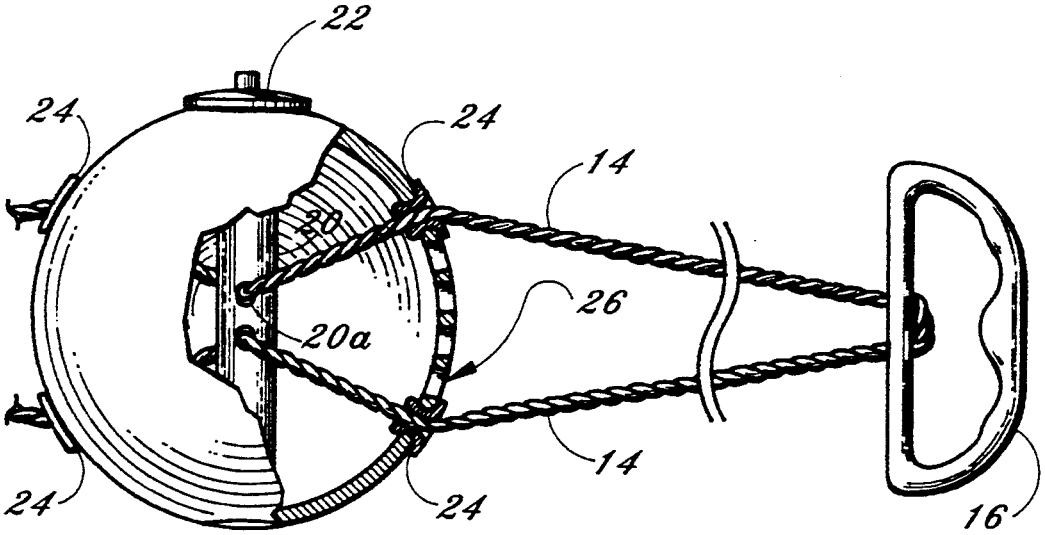
FIG. 4 shows a front elevational view, partially cut away, with the cord shown of indeterminate length on one side and fragmentary on the opposite side.
Figure 5:
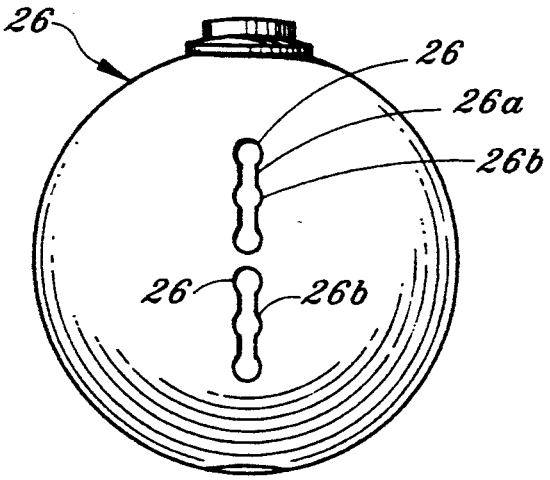
FIG. 5 shows a side elevational view of the present invention in an alternate embodiment with therefore; the aperture inserts removed for clarity.
Figure 5A:
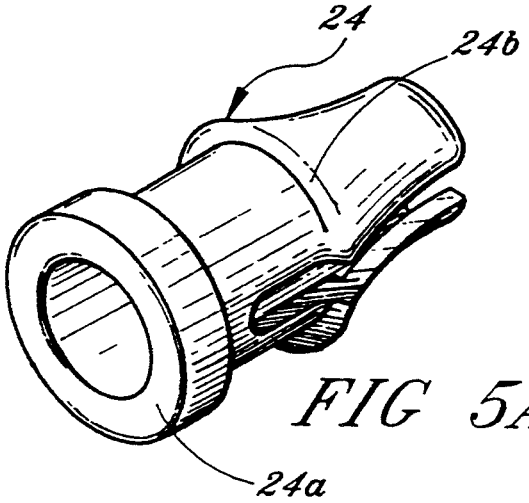
FIG. 5A shows a perspective view of an aperture insert utilized in the embodiment shown in FIGS. 4 and 5.

FIGS. 4, 5, and 5*a* show another embodiment of the invention, wherein a plurality of cord-receiving apertures are provided and a spacer for receiving the cord is utilized, to allow the user to change the particular spacing between the cord-receiving apertures on each side of the sphere. The purpose of adjusting the spacing is to make the toy or the exercising device harder or easier to pull for increasing or decreasing the force required to rotate the sphere. Essentially, a cord-receiving spacer or grommet 24 fits into a plurality of circular openings defined by a slot 26 through the side of the sphere. Each slot 26 includes a plurality of circular openings, any one of which has a diameter that fits grommet spacer 24, shown in FIG. 5A. Grommet spacer 24 also has a pair of lips 24*a* and 24*b* and a tapered portion that allows it to be resiliently placed within one of the circular openings, such as 26*b* shown in FIG. 5. An elongated opening 26*a* in the surface of sphere 26 defines a channel forming part of the overall slot 26 between circular openings. By placing a pair of spacers 24 in the desired circular portions of slot 26, the user can provide the desired separation between the cord segments 14 as they are connected into sphere 26. This increases the distance between the spacers 24, causing the separation of the cord 14 which in theory requires more energy for twisting the ball to enhance the exercise results. The apertures through shaft 20 shown in FIG. 4, such as 20*aa*, may be slotted to allow for sufficient movement of the cord to separate the cord segments 14 on each side when the spacing is changed. Thus, the spacers 24 can be easily adjusted to the desired circular openings for perfect mating with the spacer diameter midsection to provide greater challenge to the user.

Figure 6:
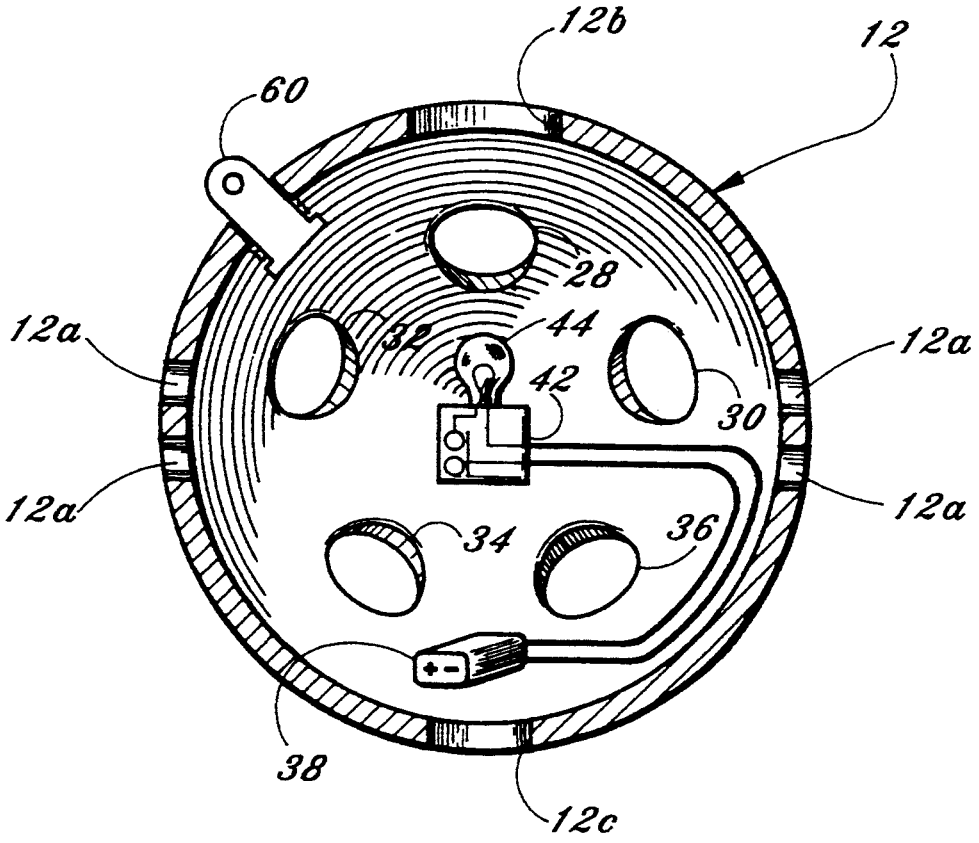
FIG. 6 shows a front elevational view in cross section, showing a lighting circuit schematically mounted inside the sphere.

FIG. 6 shows a further embodiment of the invention that includes a plurality of openings in the sphere 12 such as opening 28, opening 30, opening 32, opening 34, and opening 36. These may appear elliptical or circular from outside, but are accomplished at a predetermined angle so that as the sphere is rotated, the openings will cause the air flow to sufficiently deflect to create a variable distinctive sound that is a function of the rotational velocity of the sphere. In addition, on the inside of the sphere light 44 may be mounted and attached to a centrifugal switch 42, all of which is connected by conductors 40 to a battery 38. The switch 42 will allow the light bulb 44 to be energized by the power supply 38 upon the ball reaching a predetermined rotational velocity. This will also allow light to pass through the holes or apertures 28–36, as shown, once the bulb 44 is illuminated. The bulb, the circuitry, the switch, and the battery can be located within the sphere and firmly attached to the sphere housing at a predetermined position so that the shaft, as shown in FIGS. 2, 3, and 4, can still be employed for rolling of the string. A centrifugal variable resistor can be in switch 42 to vary the light intensity as a function of centrifugal force from rotational velocity.

In addition to the apertures 28 through 36 which create and generate sound and also permit light to pass therethrough once the bulb 44 is illuminated, an additional sound generating surface could be employed that is connected to or defined by the outer surface of the sphere. For instance, cup shapes may be employed that will interact with the air flow around the surface of the sphere to cause a distinctive sound or noise, like humming.

Figure 7:
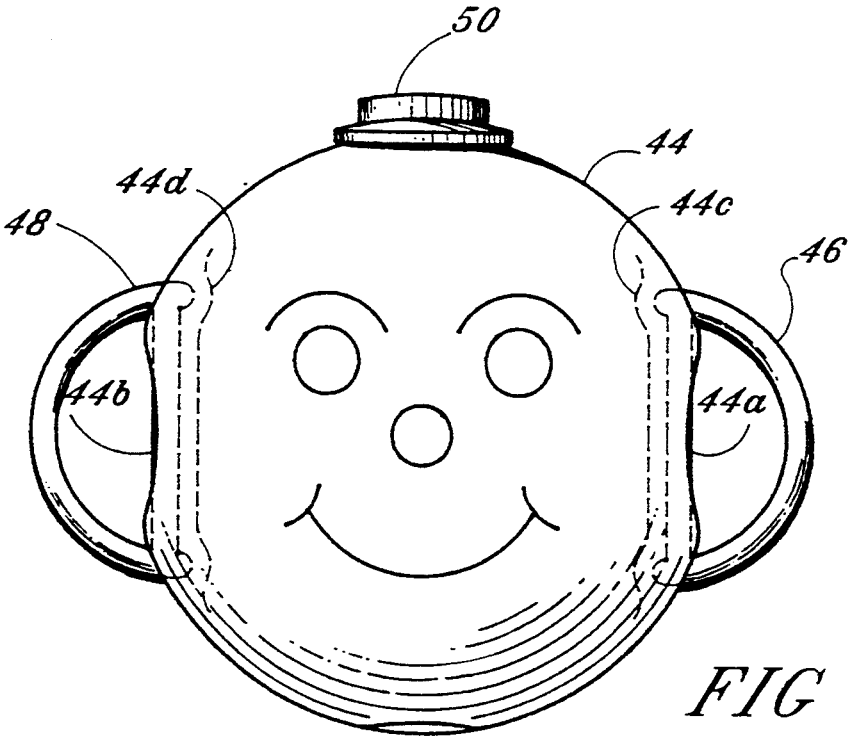
FIG. 7 shows a front elevational view of the invention in a storage position (handles stored) with an ornate indicia on the sphere body.
Figure 8:
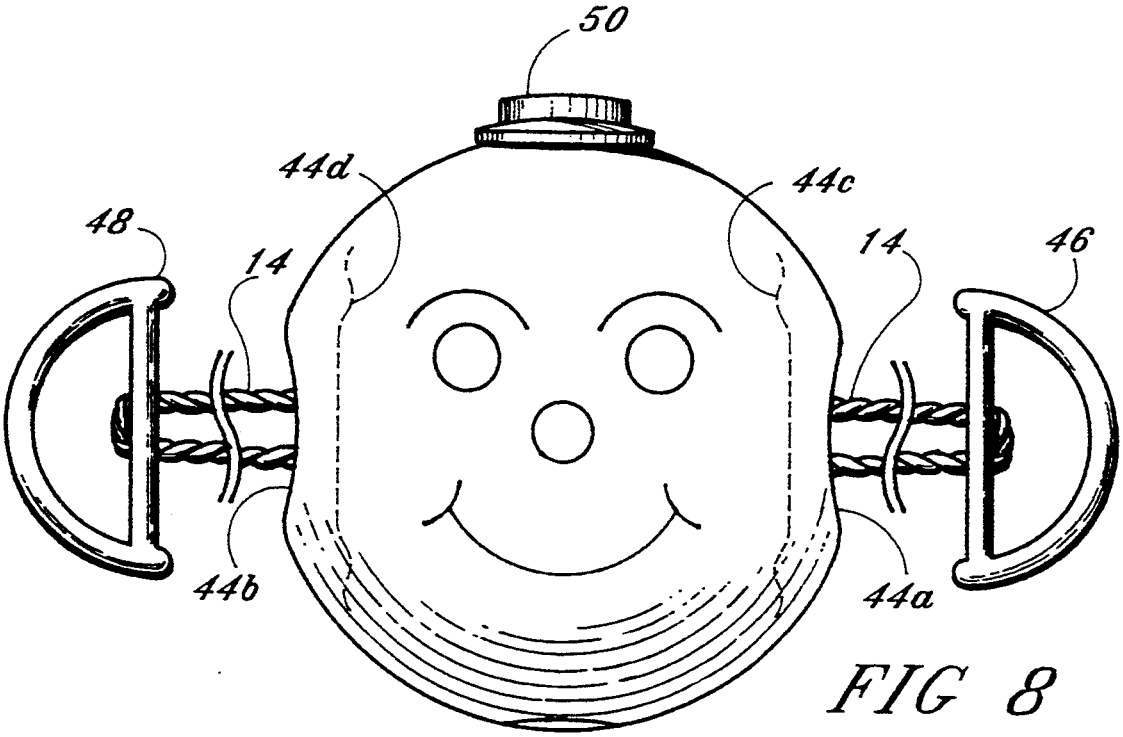
FIG. 8 shows the alternate embodiment of FIG. 7 in the operational position with the cord and handles extended outwardly.
Figure 9B:
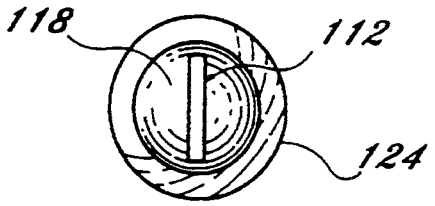
FIG. 9B is a top plan view of the shaft end shown in FIG. 9A.
Figure 10A:
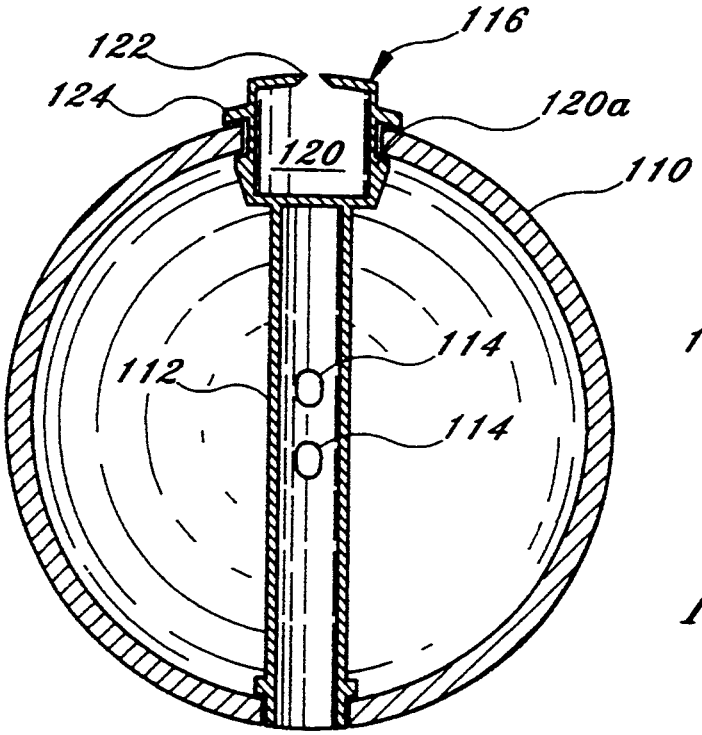
FIG. 10A shows a side elevational view of the device shown in FIG. 9A, rotated 90°.
Figure 10B:
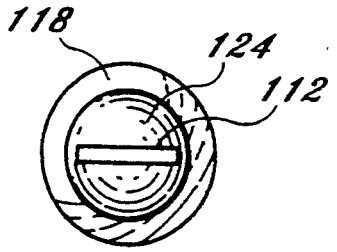
FIG. 10B is a top plan view of the shaft shown in FIG. 10A.
Figure 10A:
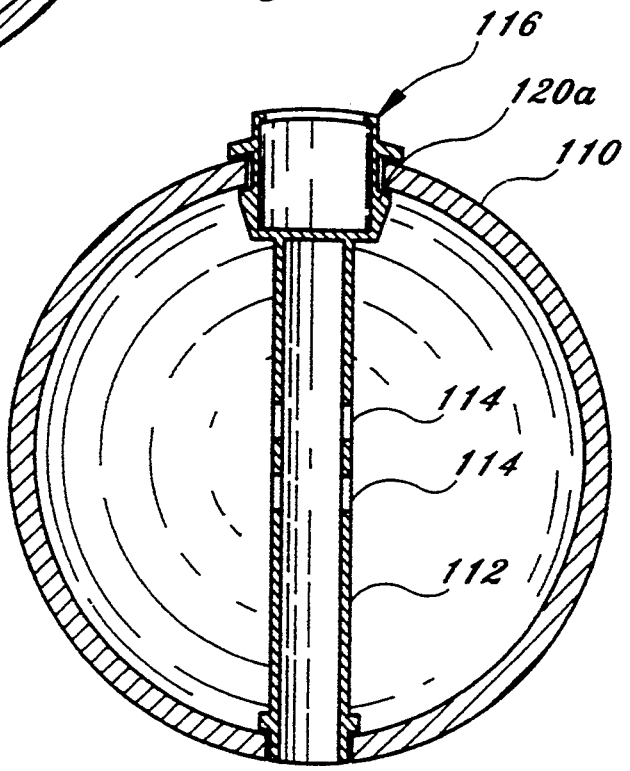

FIG. 7 shows an additional embodiment of the invention that includes D-shaped handles 46 and 48, which fit in slots mounted in the side of the sphere on opposite sides when in the stored position as shown in FIG. 7. The D-shaped handles 46 and 48 are attached to a single cord 50 of indeterminate length, as shown before. A pair of indented areas 44*a* and 44*b* include a slot that is sized to receive the thickness of the handle 46 and 48 at each side. The shaft handle 50 allows the shaft inside the sphere to be rotated, pulling the cord into the housing and the sphere, and bringing the handles 46 and 48 flush against the slot housing within the sphere surface. The slot 44*c* disposed circumferentially in sphere 44 receives handle 46. Slot 44*d*, which is also substantially circumferential, receives handle 48 in the stored position. FIG. 8 shows the handles 46 and 48 in extended, operational positions.

Referring now to FIGS. 9A, 9B, 10A, and 10B, a sound-generating or whistle-like, sound-generating device 120 is shown as formed at one end of shaft 112 that is used to attach the cord (not shown) through holes 114. The end slot 122 is rectangularly elongated, wherein the longer parallel sides are perpendicular to the rotational path of the ball 110. The slot 122, which is formed from the end cap on the shaft, has a tapered thickness starting from a narrow edge at the exterior surface to a thicker, angled portion inwardly on each side of the longer sides of the slot. The slot may be 0.25 inches wide and one inch long. As shown, the rotation of the ball will thus interact with the air flow that causes the sound box to emanate a whistle-like sound. The sound box 120 is constructed of a cylindrical wall structure 120*a* that is unitarily formed with the shaft itself and is sized slightly larger than the shaft 112, while still permitting the shaft to rotate when the cord is wrapped up around the shaft in one position or when the cord is extended for the operational position. A circular flange 124 cooperates with an annular indentation to hold the shaft 112 in place, while permitting rotation for winding the cord. The bottom of the sound box 120 is closed. By utilizing the end of the shaft 112 for the sound box and sound-generating slot formed by the end cap, other apertures or perforations in the surface area of the ball are eliminated. It has been found that the faster the ball is rotated in one direction, the pitch of the whistle sound generated changes.

The present invention is disclosed and functions both as a toy or as a serious exercising device for one person or two people. With the handles in the stored position, the device could also function as a ball that can be tossed back and forth for a completely different use. The toy and exercising device also has a decorative side that allows it to be stored with the handles becoming part of the overall structure in such a way that the cord is out of the way and the unit can be placed on a shelf for decorative purposes.

As aforementioned, the typical operation of the device, both as a toy or as an exercising device, will employ the user's skill and technique in grasping the handles and establishing a twist in the cord sufficient to commence rotation of the sphere in a first direction. By pulling very hard inwardly and separating the handles apart on the cord, unraveling the cord on each side, the rotational torque on the cord as it untwists will cause the ball to rotate rapidly until the cord is untwisted. At that point, the rotation of the ball will continue, based on the momentum established until the cord is again completely twisted. Afterward, pulling on the cord with the handles will rotate the ball in the opposite direction once the ball stops rotating. This entire reciprocal rotational movement of the ball back and forth in opposite directions can be continued until the user gets tired. As stated above, the visible indicia and audible elements of the invention can be established at certain rotational rates as desired.

In considering the overall shape of the dynamic member, disclosed herein is a sphere. The body shape could be altered to be ellipsoidal or even have some irregular portions, provided there is a central periphery having the largest circumference that is effectively perpendicular to the axis of rotation that is round or at least safely smooth so that the user would not be injured if the rotating device were to contact the user's body. Also, based on the centrifugal force that can be generated, the device can include additional dynamic ornate features such as a face that includes dynamically movable eyelids that are opened due to centrifugal force or a dynamic face that has a tongue that centrifugally moves outwardly, acting as the tongue sticking out. The device could also be ornately adorned with an exterior surface indicia that makes it look like a baseball or shaped ellipsoidally and look like a footfall.

As state above, through the centrifugal action, apertures or raised, cupped wall portions or the like could be permanently affixed or form a part of the exterior sphere surface to create sound that is a function of the velocity of the sphere, variably changing as the velocity changes. In addition, movable wall members that may be spring loaded inside could move outwardly radially, caused by centrifugal force, and include apertures for sound generation, or specifically shaped wall portions for sound generation, or even lights that come on and illuminate at a particular rotational velocity.

To relate the device to an objective measurement in terms of exercise, or even as a toy, for achieving competitive rotational velocities, a gauge that is set by the amount of centrifugal force could be mounted on a recessed portion of the sphere outer surface near the rotating periphery of maximum force that would be similar to a string gauge or centrifugal force gauge that would remain in a fixed position through a notched, ratchet-like movement caused by the centrifugal force to remain in place until manually replaced back to a zero level. This could show the user objective forces obtained through the user's skill or physical prowess.

Finally, if the body member were selectively chosen based on softness or material that may be resilient in nature, the device may have an exterior periphery body member that itself may become distorted through centrifugal force, causing the overall shape of the device to be altered during dynamic performance.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An apparatus for amusement as a toy and for use as an exercising device for manual manipulation, said apparatus comprising:

a body member having a first pair of apertures and a second pair of apertures disposed therethrough, said second pair of apertures diametrically opposed from said first pair of apertures;

a cord disposed through said body member and extending outwardly therefrom, said cord having two separated segments extending from opposite sides of said body member;

means attachable to said body member for providing variable distance between apertures disposed in said body member for receiving said cord to space the cord receiving apertures apart on opposite sides of said body member at a desired location;

said body member including a plurality of openings for generating audible sounds when said body member is rotated relative to air flow around said body member;

light illuminating means mounted in said body member; and centrifugal means connected to said illuminating means located in said body member, whereby rotation of said body member at a predetermined centrifugal force will cause said illuminating means to illuminate.

2. An apparatus as in claim 1, wherein said cord has a first end and a second end, said cord including means attached to said first end and said second end for grasping said cord, whereby said body member can be rotated by twisting said cord with said grasping means.

3. An apparatus as in claim 1, wherein said body member is spherical.

4. An apparatus as in claim 1, wherein the illumination intensity is variable as a function of rotational velocity.

5. An apparatus for amusement as a toy and for use as an exercising device for manual manipulation, said apparatus comprising:

a body member having a first pair of apertures and a second pair of apertures disposed therethrough, said second pair of apertures diametrically opposed from said first pair of apertures;

a cord disposed through said body member and extending outwardly therefrom, said cord having two separated segments extending from opposite sides of said body member; and a shaft mounted within said body member, said shaft being manually rotatable, said shaft including apertures for receiving said cord therethrough, whereby said cord can be wrapped around said shaft to allow for storage of said cord inside said body member.

6. An apparatus as recited in claim 5, including a sound box mounted at one end of said shaft, said sound box including an end cap portion having an elongated, substantially rectangular slot with tapered walls along the longer sides of the slot, said slot being oriented for rotation perpendicular to the longer side of the slot relative to the path of the ball during operation.

7. An apparatus as recited in claim 5, including means attached to said cord on each end thereof for grasping said cord, whereby said body member can be rotated by twisting said cord with said grasping means.

8. An apparatus as recited in claim 1, including means attachable to said body member for providing variable distance between apertures disposed in said body member for receiving said cord to space the apertures apart on each side of said body member at a desired location.

9. An apparatus as recited in claim 5, wherein said body member has indicia thereon.

10. An apparatus as recited in claim 7, wherein said means for grasping is a handle.

* * * * *